US010118394B2

(12) United States Patent
Munakata et al.

(10) Patent No.: US 10,118,394 B2
(45) Date of Patent: Nov. 6, 2018

(54) LIQUID EJECTING HEAD AND LIQUID EJECTING APPARATUS

(71) Applicant: SEIKO EPSON CORPORATION, Tokyo (JP)

(72) Inventors: Manabu Munakata, Matsumoto (JP); Yuji Tabata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/829,317

(22) Filed: Dec. 1, 2017

(65) Prior Publication Data

US 2018/0162132 A1 Jun. 14, 2018

(30) Foreign Application Priority Data

Dec. 14, 2016 (JP) ..... 2016-241921

(51) Int. Cl.
*B41J 2/165* (2006.01)
*B41J 2/175* (2006.01)

(52) U.S. Cl.
CPC ..... *B41J 2/16532* (2013.01); *B41J 2/165* (2013.01); *B41J 2/16517* (2013.01); *B41J 2/175* (2013.01)

(58) Field of Classification Search
CPC .... B41J 2/165; B41J 2/16517; B41J 2/16532; B41J 2/1404; B41J 2/175
USPC ..... 347/20, 29, 30, 40, 44, 47, 65
See application file for complete search history.

(56) References Cited

U.S. PATENT DOCUMENTS 6,474,769 B1 * 11/2002 Imanaka ..... B41J 2/04541 347/19
7,819,504 B2 * 10/2010 Deguchi ..... B41J 2/1433 347/55
9,132,647 B2 * 9/2015 Sujaku ..... B41J 2/175

FOREIGN PATENT DOCUMENTS

JP 2004-299347 10/2004

* cited by examiner

*Primary Examiner* — An Do
(74) *Attorney, Agent, or Firm* — Workman Nydegger

(57) ABSTRACT

A liquid ejecting head includes a flow path member in which a first substrate and a second substrate are joined to each other by an adhesive so that flow paths extending in directions along a junction surface between the first substrate and the second substrate are formed, and an ejection unit. The flow paths include a first flow path through which a first liquid flows and a second flow path through which a second liquid flows. The ratio of presence of a flow path between a demarcation wall that at least partially forms the first flow path and an external contour of the flow path member in the directions along the junction surfaces is greater than the ratio of presence of a flow path between a demarcation wall that at least partially forms the second flow path and the external contour of the flow path member.

12 Claims, 5 Drawing Sheets

LIQUID EJECTING HEAD AND LIQUID EJECTING APPARATUS

This application claims priority under 35 U.S.C. § 119 to Japanese Patent Application No. 2016-241921 filed on Dec. 14, 2016, the entire disclosure of which is expressly incorporated by reference herein.

BACKGROUND

1. Technical Field

The present invention relates to a liquid ejecting head and a liquid ejecting apparatus. More particularly, the invention relates to a liquid ejecting head that includes a flow path member having a plurality of flow paths that convey a liquid to be supplied to the liquid ejecting head and a liquid ejecting apparatus that includes the liquid ejecting head.

2. Related Art

A liquid ejecting apparatus includes a liquid ejecting head and is capable of ejecting various kinds of liquids from the ejecting head. Examples of the liquid ejecting apparatus include image recording apparatuses, such as ink jet type printers and ink jet type plotters. The liquid ejecting apparatus is capable of landing very small amounts of liquid accurately at predetermined locations and, because of this advantage, is recently applied to various production apparatuses as well. For example, the liquid ejecting apparatus is applied to display production apparatuses that produce color filters of liquid crystal displays and the like, electrode forming apparatuses that form electrodes of organic electroluminescence (EL) displays, field emission displays (FEDs), etc., and chip production apparatuses that produce biochips (biochemical devices). While a recording head for an image recording apparatus ejects liquid-state inks, a color material ejecting head for a display production apparatus ejects solutions of color materials of red (R), green (G), blue (B), etc. Furthermore, an electrode material ejecting head for an electrode forming apparatus ejects an electrode material in a liquid state, and a bioorganic material ejecting head for a chip production apparatus ejects a solution of a bioorganic material.

In a liquid ejecting apparatus that includes a liquid ejecting head, in order to inhibit defective conditions (undesirable characteristics), such as decline in ejection characteristics caused by increased viscosity of a liquid in the liquid ejecting head, the nozzle formation surface of the liquid ejecting head is sealed by a sealing member (cap) so that moisture (a solvent) of the liquid in the liquid ejecting head is inhibited from evaporating through nozzles. Furthermore, while the nozzle formation surface is sealed by the sealing member, a maintenance process (cleaning process) is performed in which the inside of the space sealed by the sealing member is suctioned by a suction mechanism so as to force out (expel) liquid having increased viscosity and air bubbles through the nozzles (see, e.g., JP-A-2004-299347). A printer as described above records images and the like by using as liquids a black ink and other color inks of magenta, cyan, yellow, etc.

The amounts of inks to be expelled by the foregoing cleaning operation are equally set with reference to a particular color ink whose undesirable characteristics caused by increased viscosity are conspicuous, more concretely, the black ink, whose deviated landing positions on a recording medium or the like caused by increased viscosity are highly visible. Therefore, it is often the case that, in the cleaning operation, the other color inks are expelled more than necessary.

SUMMARY

An advantage of an aspect of the invention is that a liquid ejecting head and a liquid ejecting apparatus that are able to reduce the amount of liquid expelled by the cleaning operation.

One aspect of the invention provides a liquid ejecting head that includes a flow path member in which a first substrate and a second substrate are joined to each other by an adhesive so that flow paths extending in directions along a junction surface between the first substrate and the second substrate are formed; and an ejection unit that ejects from nozzles liquids introduced from the flow path member. The flow paths include a first flow path through which a first liquid flows and a second flow path through which a second liquid different from the first liquid flows. A ratio of presence of a flow path between a demarcation wall that at least partially forms the first flow path and an external contour of the flow path member in the directions along the junction surfaces is greater than a ratio of presence of a flow path between a demarcation wall that at least partially forms the second flow path and the external contour of the flow path member.

According to this aspect of the invention, since the ratio of presence of a flow path between the demarcation wall that at least partially forms the first flow path and the external contour of the flow path member is greater than the ratio of presence of a flow path between the demarcation wall that at least partially forms the second flow path and the external contour of the flow path member, that is, since the first flow path has greater ratio of being surrounded by a flow path than the second flow path, evaporation of moisture (a solvent component) of the first liquid from the first flow path is inhibited. Therefore, in the case where the amounts of the liquids to be expelled by the cleaning operation of forcing the liquids from the nozzles are predetermined with reference to the first liquid, it becomes possible to reduce the total expelled amounts of all the liquids that include the other liquids.

In the foregoing liquid ejecting head of the aspect of the invention, the flow path member may have a flow path-containing space that contains a region in which the flow paths are formed, and a ratio of a portion of the demarcation wall of the first flow path which is exposed to the flow path-containing space may be smaller than a ratio of a portion of the demarcation wall of the second flow path which is exposed to the flow path-containing space.

According to this embodiment, since the demarcation wall of the first flow path has smaller ratio of being exposed to the flow path-containing space than the demarcation wall of the second flow path, evaporation of moisture of the first liquid from the first flow path into the flow path-containing space through the demarcation wall is inhibited.

In the liquid ejecting head of the aspect of the invention, the first liquid may have higher visibility than the second liquid.

According to this embodiment, because the first liquid whose undesirable characteristics, such as deviated landing positions on a landing target, caused by increased liquid viscosity are highly visible is inhibited from having increased viscosity, it becomes possible to correspondingly reduce the amount of the liquids expelled by the cleaning operation.

Furthermore, the liquid ejecting head of the invention may further include liquid storage members that store the liquids that are to be supplied to the flow path members, and a capacity of a first liquid storage member storing the first liquid may be smaller than a capacity of a second liquid storage member storing the second liquid.

Generally, the smaller the capacity of a liquid storage member, the more likely the liquid storage member is to become empty due to the liquid consumption by the cleaning operation, and therefore the more strictly the amount of liquid suction from the liquid storage member needs to be restricted. However, according to the foregoing embodiment, since evaporation of moisture of the first liquid from the first flow path is reduced so as to inhibit the first liquid from having increased viscosity, even a restricted amount of liquid suction due to the foregoing circumstance can restore the liquid ejection characteristics.

Another aspect of the invention provides a liquid ejecting apparatus that includes the liquid ejecting head of the foregoing aspect of the invention or any one of the foregoing embodiments of the liquid ejecting head and a cleaning mechanism that performs a cleaning operation of expelling the liquids from the nozzles.

According to this aspect of the invention, evaporation of moisture of the first liquid from the first flow path is inhibited, so that in the case where the amounts of the liquids to be expelled by the cleaning operation of forcing the liquids from the nozzles are predetermined with reference to the first liquid, it becomes possible to reduce the total expelled amounts of all the liquids that include the other liquids.

In this liquid ejecting apparatus, the cleaning mechanism may include a sealing member that seals a nozzle formation surface in which the nozzles of the ejection unit have openings, and the cleaning mechanism performs the cleaning operation by sucking the sealed space formed by the sealing member sealing the nozzle formation surface. The sealed space may be a space common to a nozzle that ejects the first liquid and a nozzle that ejects the second liquid and the first liquid may have higher effective moisture content than the second liquid.

According to this embodiment, although moisture (a solvent component) moves from a liquid having a high effective moisture content to a liquid having a relatively low effective moisture content via the sealed space and therefore the liquid having a relatively high effective moisture content is more likely to have increased viscosity, evaporation of moisture of the first liquid from the first flow path is inhibited, so that the amounts of moisture evaporation from the first liquid and the other liquids can be leveled out.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
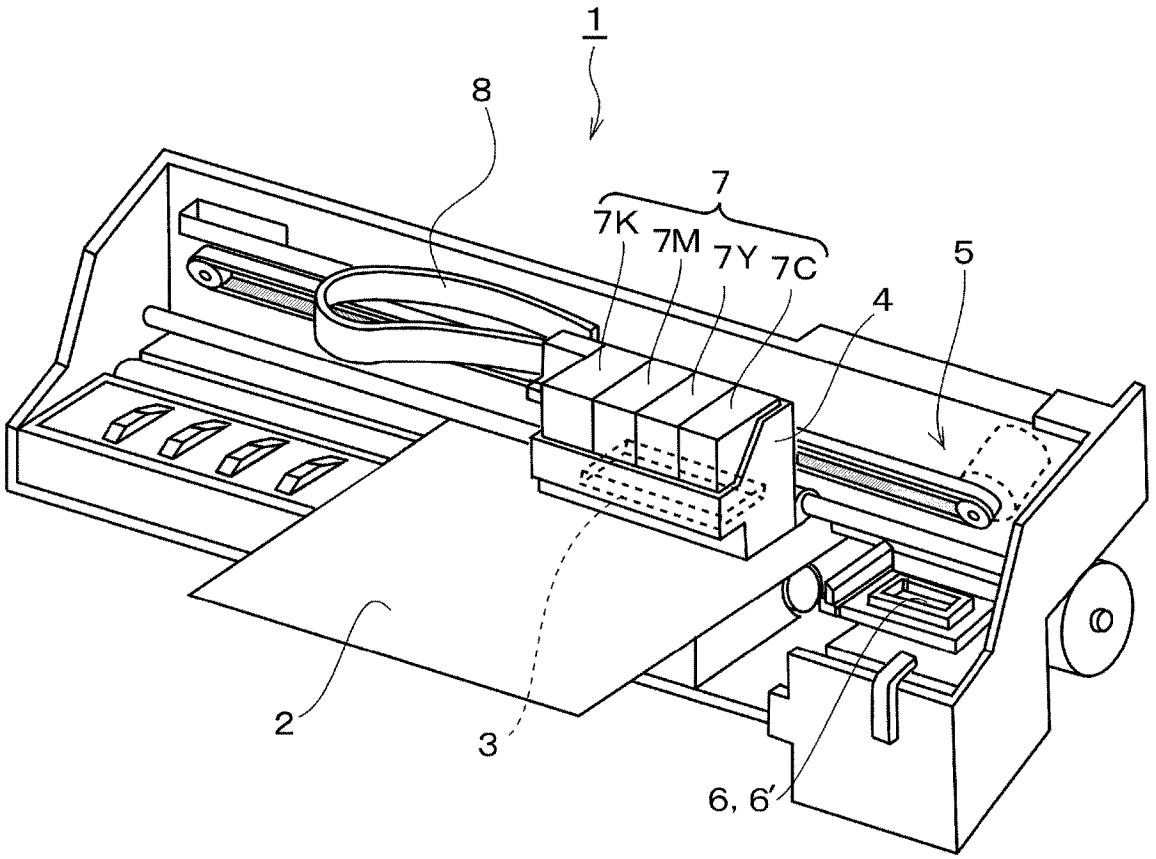
FIG. 1 is a perspective view illustrating a configuration of a printer.

Exemplary embodiments of the invention will be described hereinafter with reference to the drawings. It is to be noted that although the following exemplary embodiments include various limitations as preferred concrete examples of the invention, the scope of the invention is not limited by the following embodiments or examples unless it is mentioned that the invention is particularly limited. The following description will be made in conjunction with an ink jet type printer (hereinafter, referred to simply as "printer 1") equipped with an ink jet type recording head (hereinafter, referred to simply as "recording head 3") that is a kind of liquid ejecting head, as an liquid ejecting apparatus according to the invention.

First, a configuration of a printer 1 in this exemplary embodiment will be described with reference to FIG. 1. The printer 1 is an apparatus that records images and the like on a surface of a recording medium 2, such as a recording paper, by ejecting ink in a liquid state. The printer 1 includes a recording head 3, a carriage 4 to which the recording head 3 is attached, and a carriage moving mechanism 5 that moves the carriage 4 in a main scanning direction. The printer 1 further includes a mechanism that transports the recording medium 2 in a subsidiary scanning direction. Note that the aforementioned ink is a kind of liquid in the invention and is stored in an ink cartridge 7 that is provided as a liquid storage member. The ink cartridge 7 is detachably attached to a pin holder 10 (described later) of the recording head 3. The recording head 3 in this exemplary embodiment is configured to eject a total of four kinds (four colors) of inks. Correspondingly, a total of four ink cartridges 7 are attached to the pin holder 10. Concretely, an ink cartridge 7K storing a black ink (K), an ink cartridge 7M storing a magenta ink (M), an ink cartridge 7Y storing a yellow ink (Y), and an ink cartridge 7C storing a cyan ink (C) are disposed side by side in line in the main scanning direction. Note that the kinds and numbers of inks are not limited to those indicated as examples, inks of various compositions can be employed. It is also possible to adopt a configuration in which the ink cartridges 7 are disposed on the main body side in the printer 1 and the inks are supplied from the ink cartridges 7 to the recording head 3 through ink supply tubes. In the following description, letters K, M, Y, and C affixed to reference numerals and the like mean black, magenta, yellow, and cyan, respectively.

Within the printer 1, a capping mechanism 6 (a kind of a suction mechanism or a cleaning mechanism) is disposed at a home position that is set at one side of a movement range of the recording head 3 (at the right side in FIG. 1). The capping mechanism 6 includes a tray-shaped cap 6' (a kind of a sealing member in the invention) that is capable of contacting a nozzle formation surface (a surface of a nozzle plate 53) of the recording head 3. In this capping mechanism 6, the space inside the cap 6' functions as a sealed space and the cap 6' is capable of closely contacting the nozzle formation surface, that is, a surface in which nozzles 62 of the recording head 3 have openings, in such a manner that the nozzles 62 face the sealed space. In this exemplary embodiment, the sealed space is a space common to the nozzles 62 of the various colors (nozzle rows of the various colors). It is also possible to adopt a configuration in which caps independent of each other, corresponding to the kinds (colors) of inks is used. Air in the sealed space is sucked to a negative pressure by operating a suction pump (e.g., a tube pump) that is not depicted. In the cleaning operation, while the cap 6' is in a close contact state (capping state) with respect to the nozzle formation surface, the suction pump is operated to achieve negative pressure in the sealed space, so that inks and air bubbles in the recording head 3 are sucked through the nozzles 62 to be expelled into the sealed space of the cap 6'. The ink or the like expelled into the sealed space is sent out into a waste liquid tank (not depicted) through a waste liquid tube or the like. Note that this configuration may be replaced by, for example, a configuration in which the cleaning operation is executed by pressurizing an upstream side of the recording head 3 along the ink supply path, concretely, the interior of the ink cartridge or by using a pressurization device (flow path pump) provided in a liquid flow path.

Figure 2:
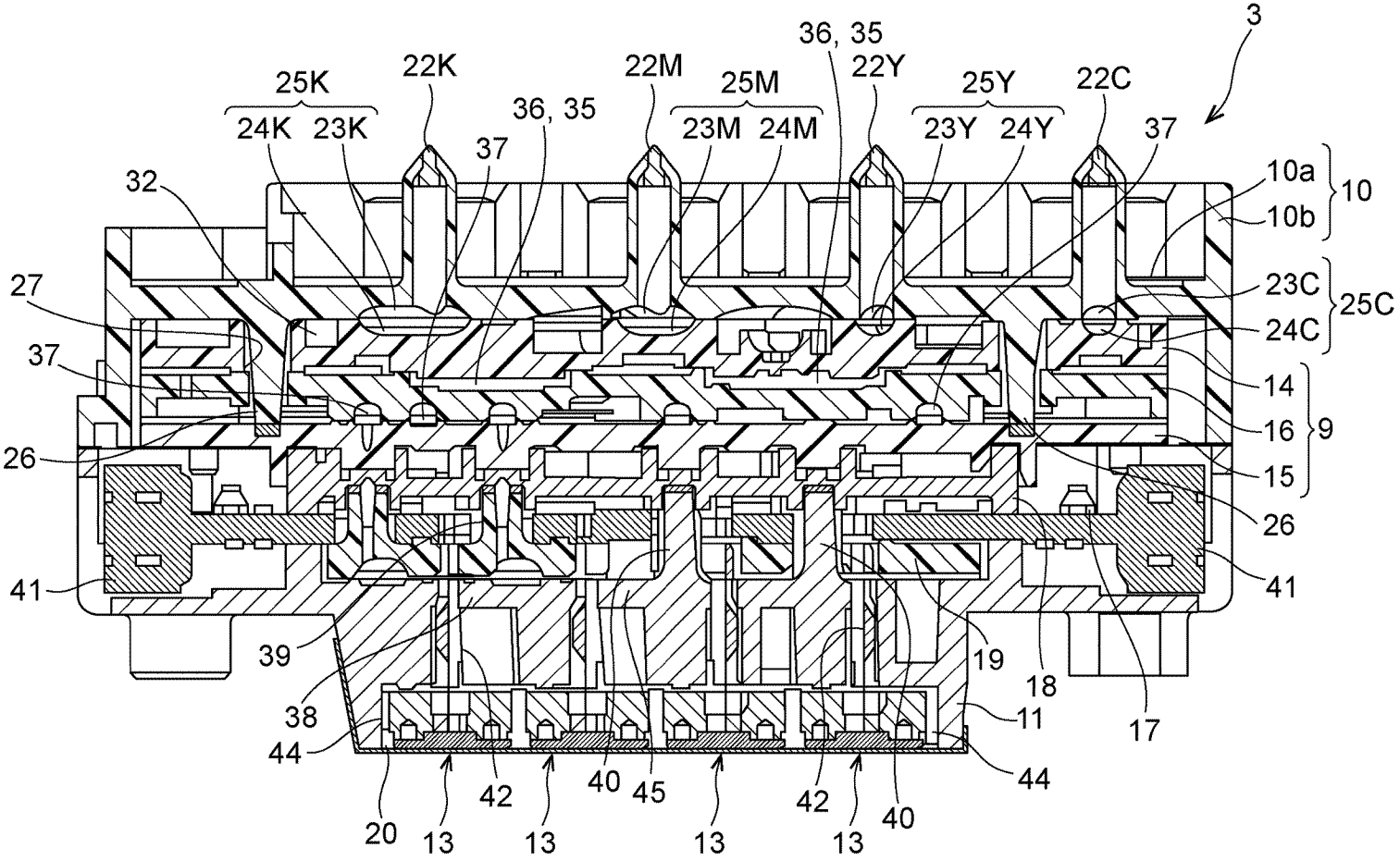
FIG. 2 is a sectional view of a recording head.

FIG. 2 is a sectional view of the recording head 3. In the following description, with reference to the nozzle formation surface of the recording head 3, directions orthogonal to the nozzle formation surface are defined as up-down directions. The recording head 3 in this exemplary embodiment includes a pin holder 10 and a head holder 11 that form an upper portion and a lower portion, respectively, of the recording head 3. The pin holder 10 and the head holder 11 house thereinside a flow path unit 9, a sealing member 18, a circuit substrate 17, a flow path-connecting member 19, a plurality of head units 13 (a kind of an ejection unit in the invention), etc. that are stacked. Furthermore, the flow path unit 9 is made up of a plurality of flow path component members, concretely, a first flow path member 14, a filter substrate 16, and a second flow path member 15, are stacked on each other and adhered to each other by an adhesive. The pin holder 10 and the head holder 11, with the aforementioned component member housed therein, are fixed to each other by, for example, a fastening member (not depicted) such as a screw or a crimp pin.

Figure 3:
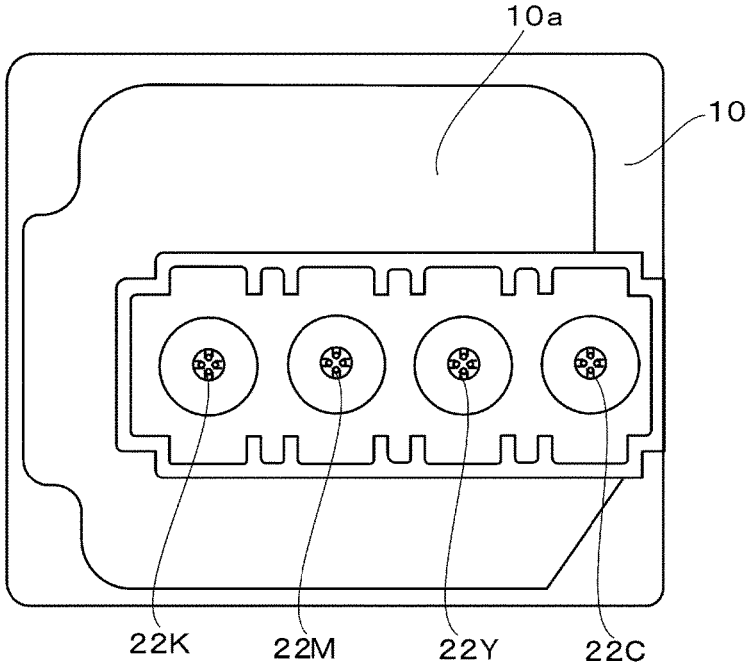
FIG. 3 is a plan view of a pin holder.

FIG. 3 is a top view of the pin holder 10. The pin holder 10 in the exemplary embodiment is a member provided with a plurality of upright introduction pins 22 and is formed from, for example, a synthetic resin such as modified polyphenylene ether containing glass filler or the like. In the exemplary embodiment, various flow path component members (a first flow path member 14, a filter substrate 16, and a second flow path member 15) that constitute the flow path unit 9 are also formed from a synthetic resin such as a modified polyphenylene ether. In the exemplary embodiment, the pin holder 10 and the first flow path member 14 of the flow path unit 9 constitute a flow path member in the invention.

The pin holder 10 has a base substrate 10*a* and side walls 10*b*. The side walls 10*b* extend upward and downward (to the head holder 11 side) from four side edges of the base substrate 10*a*. A space surrounded by the side walls 10*b* and a lower surface of the base substrate 10*a* houses the flow path unit 9. The base substrate 10*a* has on its upper surface a total of four introduction pins 22 corresponding to the color inks of the ink cartridges 7. The introduction pins 22 on the base substrate 10*a* are provided side by side in line in a direction that corresponds to the scanning directions of the recording head 3. More concretely, a first introduction pin 22K corresponding to the ink cartridge 7K of the black ink, a second introduction pin 22M corresponding to the ink cartridge 7M of the magenta ink, a third introduction pin 22Y corresponding to the ink cartridge 7Y of the yellow ink, and a fourth introduction pin 22C corresponding to the ink cartridge 7C of the cyan ink are provided side by side in that order from one side (the left side in FIGS. 2 and 3) to the opposite side (the right side in FIGS. 2 and 3) in the main scanning directions. The introduction pins 22 are hollow pin-shaped members that are to be inserted into the ink cartridges 7 so as to introduce the inks stored in the ink cartridges 7 to a first flow path member 14 side. Note that the configuration for introducing the inks from the ink cartridges 7 into the recording head 3 is not limited to a configuration that uses the introduction pins 22; for example, a configuration in which porous members capable of absorbing inks are provided on both the supply side and the receiver side and the porous members on the two sides are put into contact with each other so that the inks are transported by capillarity can be adopted.

A lower surface of the base substrate 10*a* of the pin holder 10 (a junction surface thereof with the first flow path member 14) is provided with first flow path grooves 23 recessed halfway into the base substrate 10*a* from the lower surface toward the upper surface in a sheet thickness direction. The first flow path grooves 23 communicate with second flow path grooves 24 formed on an upper surface of the first flow path member 14 (described below) and form, together with the second flow path groove 24, guide flow paths 25 (a kind of a flow path in the invention). In this case, of the pin holder 10 and the first flow path member 14, one is a kind of a first substrate in the invention and the other is a kind of a second substrate in the invention. Furthermore, the pin holder 10 and the first flow path member 14 are a kind of a flow path member in the invention. The recording head 3 in the exemplary embodiment is provided with a total of four guide flow paths 25 (25K, 25M, 25Y, and 25C) corresponding to the introduction pins 22 of the four colors. Therefore, the base substrate 10*a* is provided with a total of four first flow path grooves 23 (23K, 23M, 23Y, and 23C) corresponding to the introduction pins 22 of the colors. The guide flow paths 25 are flows path (planar flow paths) that extend in directions along the junction surface between the base substrate 10*a* and the first flow path member 14. Each guide flow path 25 communicates with an internal flow path of a corresponding one of the introduction pins 22. Specifically, when an ink cartridge 7 is attached to the pin holder 10 so that the corresponding introduction pin 22 is inserted into the ink cartridge 7, the ink in the ink cartridge 7 is introduced into the introduction pin 22 and flows down through the internal flow path to be supplied into the corresponding guide flow path 25.

A lower surface of the base substrate 10*a* is provided with a plurality of positioning pins 26 protruding downward (to the head holder 11 side). The positioning pins 26 are pins for setting the relative position of the flow path component members of the flow path unit 9 in directions orthogonal to the stacking direction. Corresponding to the positioning pins 26, a plurality of positioning holes 27 that penetrates the first flow path member 14 in its thickness direction so that the positioning pins 26 can be inserted into the positioning holes 27 (see FIG. 4). Similarly, each of the filter substrate 16 and the second flow path member 15 is provided with sites through which the positioning pins 26 are inserted or which fit over the positioning pins 26.

Figure 4:
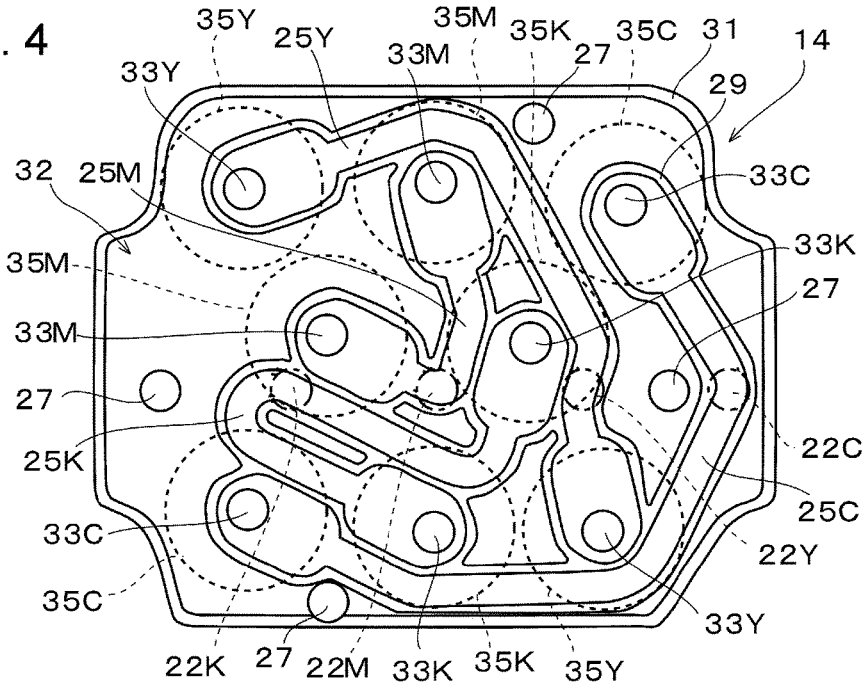
FIG. 4 is a plan view of a first flow path member.
Figure 5:
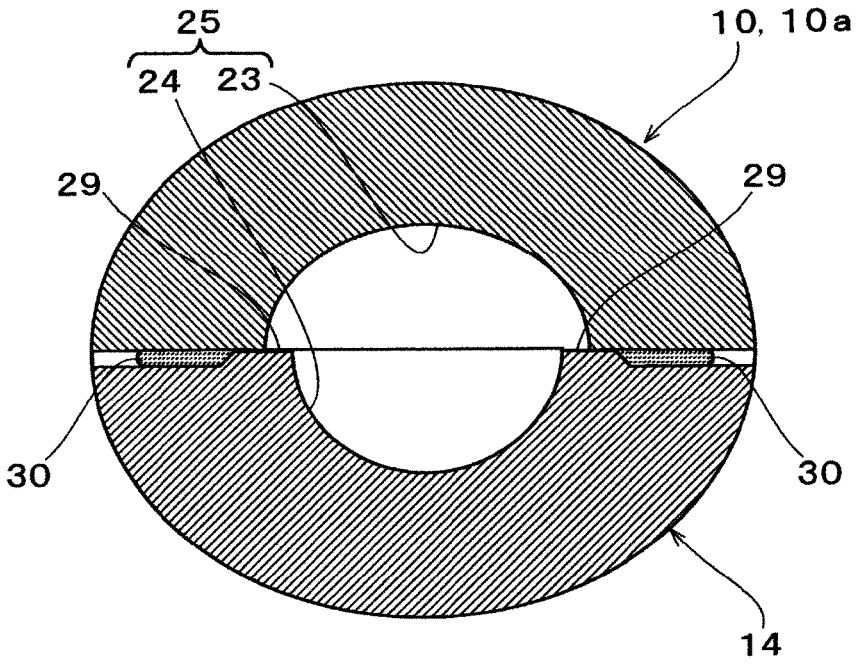
FIG. 5 is a sectional view of a guide flow path.

FIG. 4 is a plan view (top view) of the first flow path member 14. FIG. 5 is a sectional view of the guide flow paths 25 that are formed by the first flow path grooves 23 of the pin holder 10 and the second flow path grooves 24 of the first flow path member 14. Note that, in FIG. 4, circles indicated by one-dot chain lines indicate the locations of the introduction pins 22 and circles indicated by interrupted lines indicate the locations of filters 35 (of filter chambers 36). An upper surface of the first flow path member 14 (a junction surface with the base substrate 10*a*), which is one of the configuration component parts of the flow path unit 9, is provided with the second flow path groove 24 recessed halfway into the first flow path member 14 from the upper surface to the lower surface side in the sheet thickness direction. The second flow path grooves 24 correspond one-to-one to the first flow path groove 23 of the pin holder 10. As mentioned above, by communicating with the first flow path grooves 23 of the pin holder 10, the second flow path grooves 24 of the first flow path member 14 form, together with the first flow path grooves 23, the guide flow paths 25. Therefore, corresponding to the four first flow path groove 23, a total of four second flow path grooves 24 (24K, 24M, 24Y, and 24C) are formed along the junction surface.

As illustrated in FIG. 5, opening peripheral edge portions of each second flow path groove 24 of the first flow path member 14 are each provided with a demarcation wall 29 protruding to the pin holder 10 side so as to be located more to the pin holder 10 side than other portions are. The demarcation walls 29 of each second flow path groove 24 extend in the form of embankments along the opening peripheral edge portions of the second flow path groove 24. When the pin holder 10 and the first flow path member 14 are to be joined, an adhesive 30 is applied from a top surface of each demarcation wall 29 to the outer side (to the opposite side to the guide flow path 25). The pin holder 10 and the first flow path member 14 are adhered to each other, with the top surfaces of the demarcation walls 29 on the first flow path member 14 being in contact with opening peripheral edge portions of the first flow path grooves 23 of the base substrate 10*a* of the pin holder 10, so that each first flow path groove 23 and a corresponding one of the second flow path grooves 24 communicate with each other to form a guide flow path 25. Therefore, the demarcation walls 29 are portions that partially define an external shape (contour) of the guide flow paths 25.

Furthermore, as illustrated in FIG. 4, an outer peripheral edge of the upper surface (junction surface) of the first flow path member 14 is provided with an outer perimeter portion 31 similar to the demarcation wall 29. The outer perimeter portion 31 is protruded toward the pin holder 10 side so as to be located more to the pin holder 10 side than other portions of the upper surface of the first flow path member 14 are, and extends continuously along an external shape of the first flow path member 14. In this exemplary embodiment, a top surface of the outer perimeter portion 31 and top surfaces of the demarcation walls 29 are on the same plane. When the pin holder 10 and the first flow path member 14 are to be joined together, the adhesive 30 is applied to the top surface of the outer perimeter portion 31 and the pin holder 10 and the first flow path member 14 are adhered together, with the top surface of the outer perimeter portion 31 being in contact with the lower surface of the base substrate 10*a* of the pin holder 10. As a result, a flow path-containing space 32 that contains a region in which the guide flow paths 25 of the different colors are formed is defined between the pin holder 10 and the first flow path member 14. Thus, the outer perimeter portion 31 is a portion that defines the external shape (contour) of the first flow path member 14 and that separates the flow path-containing space 32 from the external space (external world).

As illustrated in FIG. 4, the flow path-containing space 32 is provided with a total of four guide flow paths 25K, 25M, 25Y, and 25C corresponding to the color inks of the ink cartridges 7. The four guide flow paths 25K, 25M, 25Y, and 25C are independent of each other without mutual intersections. Each guide flow path 25 bifurcates at (extends in two different directions from) a communication location with a corresponding one of the introduction pins 22, extending to locations that correspond to filter chambers 36 provided on the filter substrate 16. End portions (downstream end portions) of the guide flow paths 25 have a slightly larger flow path width than intermediate portions of the guide flow paths 25. Each one of these wider portions is provided with an outlet opening 33 that penetrates the first flow path member 14 in the sheet thickness direction. That is, each guide flow path 25 has a total of two outlet openings 33, that is, one outlet opening 33 in each one of the two wider end portions. These outlet openings 33 communicate with the filter chambers 36 of the filter substrate 16. Although the filter chambers 36 will be described later in detail, a total of eight filter chambers 36 are provided, each two of which correspond to one of the four color inks. The layout positions of the filter chambers 36 on the filter substrate 16 are pre-determined in relation with the locations of common liquid chambers 64 of the head units 13.

Thus, each of the guide flow paths 25 provides communication between a corresponding one of the introduction pins 22 disposed side by side on the pin holder 10 and corresponding two of the filter chambers 36 (i.e., the two filter chambers 36 for a corresponding one of the color inks) formed on the filter substrate 16, and the guide flow paths 25 do not intersect each other in the flow path-containing space 32. As a result, the guide flow paths 25 are laid out in a complicated arrangement. The layout of the guide flow paths 25 will be described later.

The filter substrate 16, which is one of the flow path component members, is provided with the filter chambers 36 in which the filters 35 are disposed. Each filter chamber 36 is a cavity whose upper surface side is open. A filter 35 is fixed to a bottom portion of each filter chamber 36. The filters 35 are members for filtering the inks that flow from the guide flow paths 25 into the filter chambers 36. Each filter 35 is formed, for example, of a finely knitted mesh of a metal or a thin metal plate with many through holes formed by plastic working. When the inks contain bubbles or undesirable substances, the bubbles or undesirable substances are trapped in the filter chambers 36 by the filters 35 and therefore prevented from flowing to the head unit 13 side. The filter chambers 36 are provided, two for each of the color inks. Therefore, in this embodiment, the filter substrate 16 is provided with a total of eight filter chambers 36. The inks, after passing through the filters 35, flow into supply flow paths 37 formed between the filter substrate 16 and the second flow path member 15.

Together with the filter substrate 16, the second flow path member 15, which is another one of the flow path component members, define a plurality of supply flow paths 37 through which the inks introduced from the filter chamber 36 side are supplied into head flow paths of the head units 13. In the exemplary embodiment, a total of eight supply flow paths 37, corresponding to the eight filter chambers 36, extend in planar directions of the second flow path member 15 as flow paths that are independent of each other without mutual intersections. That is, for each one of the colors, two supply flow paths 37 are provided. An end of each supply flow path 37, formed on a lower surface of the filter substrate 16, communicates with a corresponding one of the filter chambers 36. Of the supply flow path 37, a few supply flow paths 37 communicate with connecting flow paths 38 formed in flow path-connecting portions 39 of the flow path-connecting member 19 through sealing members 18 (described later) and communicate through connecting flow paths 38 with introduction flow paths (not depicted) of the head holder 11. The rest of the supply flow paths 37 communicate with introduction portions 40 of the head holder 11 through sealing members 18 to communicate with introduction flow paths of the head holder 11. Specifically, the sealing members 18 liquid-tightly provides communication between the pin holder 10-side liquid flow paths and the head holder 11-side liquid flow paths. In the following description, communication holes of the sealing member 18 are defined as a boundary between the pin holder 10-side liquid flow paths, which are on the upstream side of the boundary, and the head holder 11-side liquid flow path, which are on the downstream side.

The sealing member 18, the circuit substrate 17, and the flow path-connecting member 19 are disposed between the second flow path member 15 of the flow path unit 9 and the head holder 11. The sealing member 18 is formed from an elastic material, for example, an elastomer, and has, at locations corresponding to communicating portions between the supply flow paths 37 and the connecting flow paths 38 of the flow path-connecting member 19 or at locations corresponding to communicating portions between the supply flow paths 37 and the introduction portions 40 of the head holder 11, communication holes for communication with these communicating portions. This sealing member 18 liquid tightly provides communication between the pin holder 10-side liquid flow paths and the head holder 11-side liquid flow paths.

The circuit substrate 17 is a so-called printed board. The circuit substrate 17 in this exemplary embodiment includes a connector 41 to which a flexible flat cable (FFC) 8 (see FIG. 1) extending from the printer main body side is connected. Upon receiving control signals, such as a drive signal, from the printer main body side via the FFC 8, the circuit substrate 17 applies the control signals to piezoelectric elements 58 (see FIG. 6) of the head unit 13 through a wiring substrate 42. That is, the circuit substrate 17 is a substrate that relays drive signals for driving the piezoelectric elements 58 provided as driving elements (active elements). The circuit substrate 17 is provided with clearance holes through which the wiring substrate 42, the introduction portions 40 of the head holder 11, the flow path-connecting portions 39 of the flow path-connecting member 19 are inserted. The circuit substrate 17 is disposed on the head holder 11, with the flow path-connecting member 19 interposed therebetween, in such a manner that the circuit substrate 17 closes an upper surface-side opening of a region in the head holder 11 in which the flow path-connecting member 19 is disposed.

The flow path-connecting member 19 is a member made of a synthetic resin and is disposed between the circuit substrate 17 and the head holder 11. The upper surface of the flow path-connecting member 19 in this exemplary embodiment is provided with the flow path-connecting portions 39 that are protruded in a hollow cylindrical shape from the upper surface. The recording head 3 in this exemplary embodiment is provided with a total of eight rows of nozzles. A total of four flow path-connecting portions 39 that correspond to four rows of the eight rows of nozzles are provided on the flow path-connecting member 19 (of which two flow path-connecting portions 39 are illustrated in FIG. 2). As mentioned above, the connecting flow paths 38 are formed within the flow path-connecting portions 39. An end of each connecting flow path 38 communicates with a supply flow path 37 via the sealing member 18 and another end of each connecting flow path 38 communicates with an introduction flow path of the head holder 11. Furthermore, the flow path-connecting member 19 is provided with clearance holes through which the wiring substrates 42 and the introduction portions 40 of the head holder 11 are inserted.

The head holder 11 is a box-shaped member that has therein a housing chamber 44 that houses a plurality of head units 13. The head holder 11 is divided by a partition wall 45 into upper and lower regions, that is, a region in which the flow path-connecting member 19 is disposed and a region in which the housing chamber 44 is formed. An upper surface of the partition wall 45 is provided with a total of four hollow cylindrical introduction portions 40 that correspond to the other four rows of the eight rows of nozzles (which are other than the aforementioned four of the eight rows) and that protrude as upper end portions of introduction flow paths (two of the four introduction portions 40 are illustrated in FIG. 2). The introduction portions 40 communicate with the supply flow paths 37 via the sealing member 18 as mentioned above. The flow path-connecting member 19 is disposed on the upper surface of the partition wall 45.

The housing chamber 44 of the head holder 11 has an opening on a lower surface side of the head holder 11. The housing chamber 44 houses, in this exemplary embodiment, a total of four head units 13 that are positioned side by side in a direction that corresponds to the main scanning direction. Note that the number of head units 13 housed in the housing chamber 44 is not limited to four. The lower surface of each of the head units 13 in the housing chamber 44 is joined to a head cover 20 made of metal which has opening portions that expose the nozzle formation surfaces of the head units 13. The head cover 20 is adhered by an adhesive also to the lower surface of the head holder 11. Therefore, the head cover 20 and the foregoing sealing member 18 seals a space formed within the head holder 11.

Figure 6:
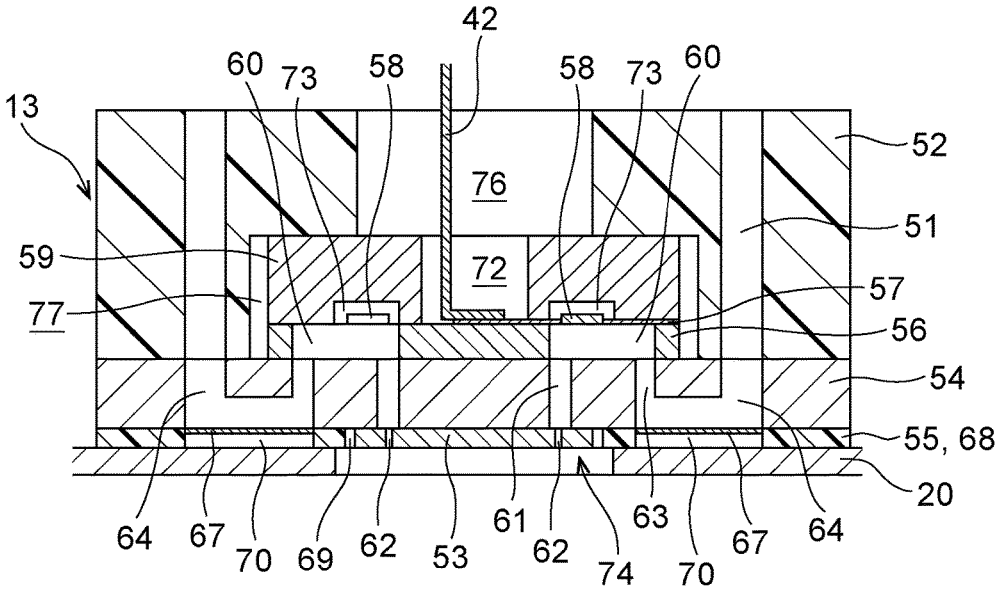
FIG. 6 is a sectional view of a head unit.

FIG. 6 is a sectional view of an example of portions of an interior of a head unit 13. In a head unit 13 in the exemplary embodiment, a plurality of head unit component members are stacked and attached to a head case 52 made of a synthetic resin. The head unit component members include a nozzle plate 53, a compliance substrate 55, a communicating substrate 54, a pressure chamber formation substrate 56, a vibration plate 57, piezoelectric elements (a kind of driving element), a protective substrate 59, etc.

The pressure chamber formation substrate 56 is formed from a silicon single crystal substrate (hereinafter, also referred to simply as "silicon substrate"). The pressure chamber formation substrate 56 is provided with a plurality of cavities for forming pressure chambers 60. The cavities are formed by performing an anisotropic etching process on a silicon substrate. These cavities penetrate the pressure chamber formation substrate 56 in its thickness direction. One of two openings of each cavity is sealed by the vibration plate 57 and the other opening of each cavity is sealed by the communicating substrate 54 to form a pressure chamber 60. Note that the term pressure chamber 60 used hereinafter includes such a cavity. In this exemplary embodiment, the nozzle plate 53 of each head unit 13 is provided with two nozzle row, each nozzle row having a plurality of nozzles 62. Therefore, the pressure chamber formation substrate 56 is provided with two rows of pressure chambers 60 that correspond to the two nozzle rows. Each pressure chamber 60 is a cavity elongated in a direction that intersects (in this exemplary embodiment, orthogonally intersects) an side-by-side direction of the nozzle 62 (nozzle row direction). When the pressure chamber formation substrate 56 is positioned relative to the communicating substrate 54 in a manner described below and is joined to the communicating substrate 54, an end portion of each pressure chamber 60 in its longitudinal direction communicates with a nozzle 62 through a nozzle communication path 61 of the communicating substrate 54. The other end portion of each pressure chamber 60 in its longitudinal direction communicates with a common liquid chamber 64 through an individual communication opening 63 of the communicating substrate 54.

The upper surface of the pressure chamber formation substrate 56 (an opposite side surface of the pressure chamber formation substrate 56 to the junction surface of the communicating substrate 54) is provided with the vibration plate 57 that is formed so as to seal upper openings of the pressure chambers 60. The vibration plate 57 is made of, for example, silicon dioxide. An insulation film (not depicted) is formed on the vibration plate 57. The insulation film is made of, for example, zirconium oxide. The piezoelectric elements 58 are formed at locations on the vibration plate 57 and the insulation film which correspond to the pressure chambers 60. The piezoelectric elements 58 in this exemplary embodiment are so-called flexure mode piezoelectric elements. The piezoelectric elements 58 are formed on the vibration plate 57 and the insulation film by sequentially stacking a lower electrode film made of metal, a piezoelectric substance layer made of lead zirconate titanate (PZT) or the like, and an upper electrode film made of metal (none of which is depicted) and performing patterning separately for each pressure chamber 60. One of the upper electrode film or the lower electrode film is formed as a common electrode and the other is formed as individual electrodes. The vibration plate 57, the insulation film, and the lower electrode film function as a drive region when a piezoelectric element 58 is driven.

A lead electrode extends out from each piezoelectric element 58 onto the vibration plate 57. Portions of the lead electrodes which correspond to electrode terminals are connected with one end-side terminals of the wiring substrates 42. The piezoelectric elements 58 undergo flexure deformation by selectively applying thereto a drive signal (drive voltage) between the upper electrode film and the lower electrode film through the wiring substrate 42.

The communicating substrate 54 joined to the lower surface of the pressure chamber formation substrate 56 is a plate member formed from a silicon substrate similarly to the pressure chamber formation substrate 56. The communicating substrate 54 is provided with the common liquid chambers 64 (termed reservoirs or manifolds) each of which is a cavity common to the pressure chambers 60 of a corresponding one of the pressure chamber rows. The common liquid chambers 64 are formed by anisotropic etching. The ink introduced into an introduction pin 22 flows down through the pin holder 10-side liquid flow path, that is, the guide flow path 25, the filter chamber 36, and the supply flow path 37, and then flows down through the head holder 11-side liquid flow path, that is, the connecting flow path 38, the introduction flow path, and the case flow path 51, sequentially, to flow into the common liquid chamber 64. The ink having flown in the common liquid chamber 64 is supplied to the pressure chambers 60 through the individual communication openings 63 that are formed corresponding to the pressure chambers 60.

The compliance substrate 55 is joined to the lower surface of the communicating substrate 54. The compliance substrate 55 is, for example, a composite material made up of a thin compliance sheet 67 made up, for example, polyphenylene sulfide resin (PPS), and a sheet support plate 68 made of metal which supports the compliance sheet 67. The sheet support plate 68 has, in regions that face the common liquid chambers 64, compliance openings 70 that are formed by removing portions of the sheet support plate 68 so as to have a shape similar to that of the lower surface openings of the common liquid chambers 64. Therefore, the lower surface-side openings of the common liquid chambers 64 are sealed only by the flexible compliance sheet 67.

Lower surface-side portions of the sheet support plate 68 which correspond to the compliance openings 70 are sealed by the head cover 20. Thus, compliance spaces are formed between flexible regions of the compliance sheet 67 and the head cover 20 facing the flexible region. As a result, the flexible region of the compliance sheet 67 facing a compliance space can be displaced to the common liquid chamber 64 or the compliance space side according to a pressure change within the ink flow path, particularly, in the common liquid chamber 64. The compliance substrate 55 has in its central portion a substrate opening portion 69 whose shape is similar to an external shape of the nozzle plate 53. That is, when the compliance substrate 55 and the nozzle plate 53 are joined to the communicating substrate 54, the nozzle plate 53 is disposed in the substrate opening portion 69 of the compliance substrate 55. It suffices that the compliance sheet 67 is a flexible member capable of being flexed according pressure changes in the ink flow paths (the common liquid chambers 64). For example, the compliance sheet 67 may be a metal plate such as a very thin stainless steel plate.

The protective substrate 59 is disposed on the upper surface of the pressure chamber formation substrate 56 that is provided with the piezoelectric elements 58. The protective substrate 59 is a hollow box-shaped member formed from, for example, a silicon substrate or the like. The protective substrate 59 has in its central portion a wiring cavity 72 that penetrates the central portion in the substrate thickness direction. Inside the wiring cavity 72 there are disposed connecting portions between the aforementioned lead electrodes of the piezoelectric elements 58 and the end portion of the wiring substrate 42. Furthermore, the protective substrate 59 has in regions that face the piezoelectric elements 58, more concretely, regions at both sides of the wiring cavity 72 in a direction orthogonal to the pressure chamber side-by-side direction (row direction), housing spaces 73 that have such a size as to avoid inhibiting the driving of the piezoelectric elements 58. The housing spaces 73 extend from the lower surface of the protective substrate 59 (the junction surface thereof with the pressure chamber formation substrate 56) to the upper surface side in the substrate thickness direction to an intermediate portion of the protective substrate 59 in the substrate thickness direction.

The nozzle plate 53 is a plate member that has openings of a plurality of nozzles 62 arranged in rows with a pitch that corresponds to the dot density. In this exemplary embodiment, the nozzle plate 53 is formed from a silicon substrate. In this nozzle plate 53, rows of nozzles 62 are arranged by disposing a plurality of nozzles 62 side by side with a predetermined pitch in the rows. In the exemplary embodiment, the nozzle plate 53 of each head unit 13 is provided with two rows of nozzles (two nozzle rows). The silicon substrate is subjected to dry etching to form hollow cylindrically shaped nozzles 62. The longitudinal and lateral dimensions of the nozzle plate 53 are set smaller than the longitudinal and lateral dimensions of the substrate opening portion 69 of the compliance substrate 55 and of the opening portion 74 of the head cover 20. When the nozzle plate 53 is positioned with respect to the communicating substrate 54 and joined to the communicating substrate 54, the nozzle plate 53 is disposed in these opening portions 69 and 74. In this state, the nozzle communication paths 61 of the communicating substrate 54 and the nozzles 62 communicate with each other.

The head case 52 is a box-shaped member made of a synthetic resin. The lower surface side of the head case 52 is joined with the communicating substrate 54. The head case 52 has in its central portion a through cavity 76 (a portion of a wiring space) that penetrates the head case 52 in its height direction. The through cavity 76 communicates with the wiring cavity 72 of the protective substrate 59, thus forming a cavity that houses the wiring substrate 42. Furthermore, the head case 52 has on its lower surface side a housing cavity 77 that is recessed from the lower surface to an intermediate portion of the head case 52 in its height direction. The housing cavity 77 has such a size that when the head case 52 and the communicating substrate 54 are positioned and joined to each other, the housing cavity 77 can house the pressure chamber formation substrate 56 provided on the communicating substrate 54, the piezoelectric elements 58, the protective substrate 59, etc. A lower end portion of the through cavity 76 has an opening in a ceiling surface of the housing cavity 77.

The head case 52 is provided with case flow paths 51 that penetrate the head case 52 in its height direction. Each case flow path 51 is formed at a location that is apart from the housing cavity 77 of the head case 52 to an outer side in a direction orthogonal to the pressure chamber side-by-side direction. More concretely, the head case 52 has a total of two case flow paths 51, that is, one at each of two opposite sides of the housing cavity 77, corresponding to the common liquid chambers 64 of the communicating substrate 54. When the communicating substrate 54 is joined to the head case 52, each case flow path 51 communicates with a corresponding one of the common liquid chambers 64.

The head cover 20 is, for example, a plate member made of a metal such as a stainless steel. The head cover 20 in this exemplary embodiment, as described above, is provided with the opening portion 74 whose shape is similar to the external shape of the nozzle plate 53 and which penetrates the head cover 20 in its thickness direction. The opening portion 74 is formed at a location that corresponds to the nozzle plate 53 in order to expose the nozzles 62 formed on the nozzle plate 53. In this exemplary embodiment, the exposed area of the nozzle plate 53 in the opening portion 74 and the lower surface of the head cover 20 form a nozzle formation surface.

Then, in the recording head 3 configured as described above, while the flow paths extending from the common liquid chambers 64 through the pressure chambers 60 to the nozzles 62 are filled with the inks, the piezoelectric elements 58 are selectively driven according to drive signals from the wiring substrates 42 to cause pressure changes in the inks in predetermined pressure chambers 60 and therefore eject inks from the predetermined nozzles 62.

By the way, in the recording head 3 configured as described above, the space between the pin holder 10 and the head holder 11 in which the flow path unit 9 and the like are disposed are tightly closed so that a certain humidity is maintained. However, complete prevention of evaporation of ink from a flow path is difficult. In particular, as for the guide flow path 25, the supply flow path 37, etc. that are defined by joining a plurality of component members with an adhesive, a solvent component of ink is likely to evaporate through an adhered portion. In conjunction with this, it is conceivable to adopt an adhesive that has low moisture permeability. However, this is disadvantageous in ease of operation and cost. When the nozzle formation surface of the recording head 3 is released from the sealed state (capping) established by the capping mechanism 6 to record an image or the like on the recording medium 2, the nozzles 62 are exposed to the atmosphere, so that the ink in the vicinity of the nozzles 62 has increased viscosity. Increased viscosity of ink may possibly inhibit normal discharge of ink drops from the nozzles 62. Therefore, the printer 1 periodically performs a cleaning operation by using the capping mechanism 6. In this type of printer, the amounts of the inks to be expelled by the cleaning operation are equally set with reference to a particular color ink which has higher visibility than the other color inks and whose undesirable characteristics caused by increased viscosity are conspicuous, more concretely, the black ink, whose deviated landing positions on a recording medium or the like caused by increased viscosity are highly visible (which has a relatively small permissible range of landing position deviation). In this case, in a configuration of a recording head in which volatilization of moisture (solvent component) of the black ink is likely, there is a possibility that if a cleaning operation is performed with a suction amount set with reference to the black ink, the other color inks (corresponding to a second liquid in the invention) may be expelled more than necessary. Note that having relatively high visibility means having a relatively low luminance value in the case of a light color, such as white, on the recording medium.

Therefore, the printer 1 according to the invention is configured so that evaporation of a solvent in a flow path that corresponds to a first liquid (the black ink in this exemplary embodiment) used as a reference for the amount of an ink expelled by the cleaning operation is inhibited as much as possible so as to reduce the amounts of the color inks expelled by the cleaning operation.

Figure 7:
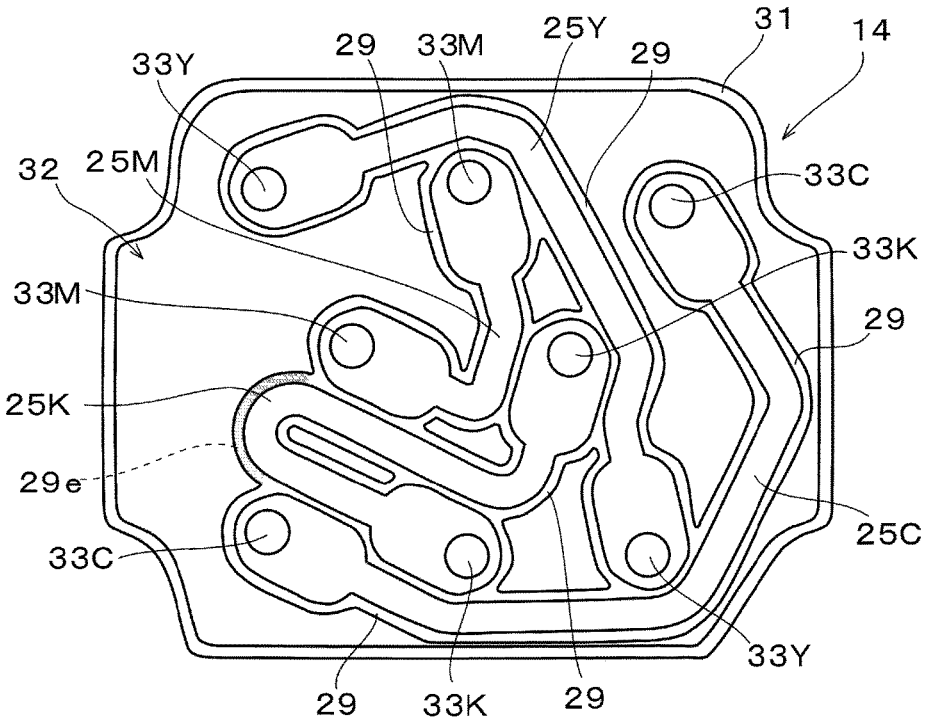
FIG. 7 is a plan view illustrating a layout of the guide flow path.

FIG. 7 is a plan view of the first flow path member 14 illustrating a layout of the guide flow path 25. As illustrated in FIG. 7, the guide flow paths 25 (25K, 25M, 25Y, and 25C) are laid out so that with regard to the guide flow path 25K that corresponds to the black ink (corresponding to a first flow path in the invention), the ratio of the presence of a guide flow path 25 (the guide flow path 25 concerned (the guide flow path 25K) or another guide flow path 25) between the demarcation wall 29 that defines the external shape of the guide flow path 25K and the outer perimeter portion 31 that defines the external shape of the first flow path member 14 in directions along the junction surface between the first flow path member 14 and the base substrate 10*a* (i.e., the ratio of the length of the aforementioned portion of the demarcation wall 29 of the guide flow path 25 concerned to the total length of the entire demarcation wall 29 of the guide flow path 25 concerned; the same applies below) is greater than the ratios of presence of a guide flow path 25 between the demarcation walls 29 of the guide flow paths 25M, 25Y, and 25C (corresponding to a second flow path in the invention) and the outer perimeter portion 31. That is, in FIG. 7, the first flow path member 14 has a layout such that, in terms of the ratio of presence of a guide flow path 25 on an imaginary normal extending in a direction along the junction surface from the demarcation wall 29 that defines the contour of a guide flow path 25 concerned, the guide flow path 25K is greater than any one of the guide flow paths 25M, 25Y, or 25C.

In other words, the ratio of a portion of the demarcation wall 29 of the guide flow path 25K which is exposed to the flow path-containing space 32 is smaller than the ratio of a portion of the demarcation wall 29 of any one of the other guide flow paths 25 which is exposed to the flow path-containing space 32. Note that the flow path-containing space 32 is a space formed between the outer perimeter portion 31 and the demarcation walls 29 of the guide flow paths 25. Of the demarcation wall 29 of the guide flow path 25K, the portion (29*e*) exposed to the flow path-containing space 32 is only a portion indicated by hatching in FIG. 7. In contrast, the portion of the demarcation wall 29 of any one of the other guide flow paths 25M, 25Y, and 25C which is exposed to the flow path-containing space 32 is larger than the exposed portion 29*e* of the guide flow path 25K.

Thus, the guide flow path 25K that corresponds to the black ink has a greater ratio of being surrounded by one or more guide flow paths 25 than any one of the other guide flow paths 25M, 25Y, and 25C, so that evaporation of moisture (a solvent component) less readily occurs from the black ink through an adhered portion of the demarcation wall 29 of the guide flow path 25K than from any one of the other inks. Therefore, in the case where the amounts of the inks to be expelled (the suction amounts of the inks) by the cleaning operation are predetermined with reference to the black ink, it becomes possible to reduce the total expelled amounts of all the inks that include the other inks.

Although in conjunction with the foregoing exemplary embodiment, a configuration in which the amount of the inks to be expelled by the cleaning operation is predetermined with reference to the black ink is illustrated as an example, the amount of inks to be expelled by the cleaning operation may be predetermined with reference to a color ink (a kind of ink) other than the black ink. In that case, the flow path that corresponds to the ink concerned is laid out together with the other flow paths similarly to the guide flow path 25K in the foregoing exemplary embodiment.

Furthermore, the layout of flow paths as described above can be applied not only to the guide flow paths 25 but also to flow paths that are defined by joining a plurality of component members, for example, the supply flow paths 37 defined between the filter substrate 16 and the second flow path member 15. In that case, one of the filter substrate 16 and the second flow path member 15 can be regarded as a kind of the first substrate in the invention, the other can be regarded a kind of the second substrate in the invention, the supply flow path 37 can be regarded as a kind of the flow path in the invention, and the filter substrate 16 and the second flow path member 15 can be regarded as kinds of the flow path member in the invention.

The invention is not limited to the foregoing exemplary embodiment but can be modified in various manners based on the description in the appended claims.

Although in the foregoing exemplary embodiment, the foregoing flow path layout is adopted with respect to the guide flow path 25K that corresponds to the black ink, whose visibility is relatively high, among the four color inks, this does not limit the invention. A layout as adopted with respect to the guide flow path 25K may be adopted with respect to a flow path (first flow path) that corresponds to an ink (first liquid) that has a higher effective moisture content than any one of the other inks (second liquid). For example, in the foregoing capping mechanism 6, the space inside the cap 6' is a space common to the nozzles 62 of the four colors. In such a configuration, moisture (solvent component) moves from an ink having a high effective moisture content to an ink having a relatively low effective moisture content via the sealed space, so that the ink having a relatively high effective moisture content is more likely to have increased viscosity. Note that the effective moisture content means a value obtained by subtracting from the amount of moisture contained in an ink the amount of moisture absorbed into a moisture absorbent such as glycerin. When a layout as described above with respect to the guide flow path 25K is adopted with respect to a flow path that corresponds to an ink having a high effective moisture content, evaporation of moisture of the ink concerned from the guide flow path 25 is inhibited, so that the amounts of moisture evaporation from the ink concerned and the other inks can be leveled out.

Furthermore, a layout as adopted with respect to the guide flow path 25K can also be adopted with respect to a flow path (first flow path) that corresponds to an ink (first liquid) stored in an ink cartridge 7 (corresponding to a first liquid storage member in the invention) having a smaller capacity than the other ink cartridges 7 (corresponding to a second liquid storage member in the invention) storing other inks (second liquid). The smaller the capacity of an ink cartridge 7, the more likely the ink cartridge 7 is to run out of ink due to the ink consumption by the cleaning operation, and therefore the more strictly the amount of ink suction from the ink cartridge 7 needs to be restricted. However, since the adoption of the foregoing flow path layout reduces moisture evaporation from the flow path that corresponds to the ink concerned and therefore inhibits the ink from having increased viscosity, even a restricted amount of ink suction due to the foregoing circumstance can restore the ink ejection characteristics (the amount of ink ejected from the nozzles and the flying speed of ejected ink).

Although the ink jet type recording head 3 has been described above as an example of the liquid ejecting head of the invention, the invention is also applicable to other liquid ejecting heads that adopt a configuration in which component members that define liquid flow paths are joined by using an adhesive. The invention is also applicable to, for example, color material ejecting heads for use in producing color filters of liquid crystal displays and the like, electrode material ejecting heads for use in forming electrodes of organic electro-luminescence (EL) displays, field emission displays (FEDs), etc., bioorganic material ejecting heads for use in producing bio-chips (biochemical devices), etc.

What is claimed is:

1. A liquid ejecting head comprising:

a flow path member in which a first substrate and a second substrate are joined to each other by an adhesive so that flow paths extending in directions along a junction surface between the first substrate and the second substrate are formed; and an ejection unit that ejects from nozzles liquids introduced from the flow path member, wherein the flow paths include a first flow path through which a first liquid flows and a second flow path through which a second liquid different from the first liquid flows, and wherein a ratio of presence of a flow path between a demarcation wall that at least partially forms the first flow path and an external contour of the flow path member in the directions along the junction surfaces is greater than a ratio of presence of a flow path between a demarcation wall that at least partially forms the second flow path and the external contour of the flow path member.

2. The liquid ejecting head according to claim 1, wherein the flow path member has a flow path-containing space that contains a region in which the flow paths are formed, and wherein a ratio of a portion of the demarcation wall of the first flow path which is exposed to the flow path-containing space is smaller than a ratio of a portion of the demarcation wall of the second flow path which is exposed to the flow path-containing space.

3. A liquid ejecting apparatus comprising:

the liquid ejecting head according to claim 2; and a cleaning mechanism that performs a cleaning operation of expelling the liquids from the nozzles.

4. The liquid ejecting apparatus according to claim 3, wherein the cleaning mechanism includes a sealing member that seals a nozzle formation surface in which the nozzles of the ejection unit have openings, and the cleaning mechanism performs the cleaning operation by sucking the sealed space formed by the sealing member sealing the nozzle formation surface, and wherein the sealed space is a space common to a nozzle that ejects the first liquid and a nozzle that ejects the second liquid, and wherein the first liquid has higher effective moisture content than the second liquid.

5. The liquid ejecting head according to claim 1, wherein the first liquid has higher visibility than the second liquid.

6. A liquid ejecting apparatus comprising:

the liquid ejecting head according to claim 5; and a cleaning mechanism that performs a cleaning operation of expelling the liquids from the nozzles.

7. The liquid ejecting apparatus according to claim 6, wherein the cleaning mechanism includes a sealing member that seals a nozzle formation surface in which the nozzles of the ejection unit have openings, and the cleaning mechanism performs the cleaning operation by sucking the sealed space formed by the sealing member sealing the nozzle formation surface, and wherein the sealed space is a space common to a nozzle that ejects the first liquid and a nozzle that ejects the second liquid, and wherein the first liquid has higher effective moisture content than the second liquid.

8. The liquid ejecting head according to claim 1, further comprising liquid storage members that store the liquids that are to be supplied to the flow path members, wherein a capacity of a first liquid storage member storing the first liquid is smaller than a capacity of a second liquid storage member storing the second liquid.

9. A liquid ejecting apparatus comprising:

the liquid ejecting head according to claim 8; and a cleaning mechanism that performs a cleaning operation of expelling the liquids from the nozzles.

10. The liquid ejecting apparatus according to claim 9, wherein the cleaning mechanism includes a sealing member that seals a nozzle formation surface in which the nozzles of the ejection unit have openings, and the cleaning mechanism performs the cleaning operation by sucking the sealed space formed by the sealing member sealing the nozzle formation surface, and wherein the sealed space is a space common to a nozzle that ejects the first liquid and a nozzle that ejects the second liquid, and wherein the first liquid has higher effective moisture content than the second liquid.

11. A liquid ejecting apparatus comprising:

the liquid ejecting head according to claim 1; and a cleaning mechanism that performs a cleaning operation of expelling the liquids from the nozzles.

12. The liquid ejecting apparatus according to claim 11, wherein the cleaning mechanism includes a sealing member that seals a nozzle formation surface in which the nozzles of the ejection unit have openings, and the cleaning mechanism performs the cleaning operation by sucking the sealed space formed by the sealing member sealing the nozzle formation surface, and wherein the sealed space is a space common to a nozzle that ejects the first liquid and a nozzle that ejects the second liquid, and wherein the first liquid has higher effective moisture content than the second liquid.

* * * * *